United States Patent [19]

Pettit

[11] Patent Number: 4,884,751

[45] Date of Patent: Dec. 5, 1989

[54] LAWN SPRINKLER

[75] Inventor: Edgar E. Pettit, Houston, Tex.

[73] Assignee: Lil' Duke Sprinkler, Inc., Houston, Tex.

[21] Appl. No.: 181,321

[22] Filed: Apr. 13, 1988

[51] Int. Cl.[4] ..... B05B 1/34

[52] U.S. Cl. ..... 239/468; 239/104; 239/273; 239/491; 220/359; 403/375

[58] Field of Search ..... 239/468, 104, 463, 491, 239/492, 490, 273; 403/345, 375; 220/359; 215/232

[56] References Cited

U.S. PATENT DOCUMENTS

| | | | |
|---|---|---|---|
| 1,780,233 | 11/1930 | Jenkins | 239/468 |
| 2,519,738 | 8/1950 | Butler | 239/468 |
| 2,815,248 | 12/1957 | O'Brien | 239/468 |
| 3,304,013 | 2/1967 | O'Brien | 239/468 |
| 3,326,473 | 6/1967 | Wahlin | 239/468 |
| 3,550,859 | 12/1970 | Pettit | 239/491 |
| 3,843,059 | 10/1974 | Segev | 239/273 |
| 3,910,448 | 10/1975 | Evans et al. | 220/359 |
| 3,944,138 | 3/1976 | Easton | 239/273 |
| 4,092,003 | 5/1978 | Ikeuchi | 239/590 |
| 4,173,308 | 11/1979 | Savvides | 239/468 |
| 4,195,748 | 4/1980 | Del Bon | 220/359 |
| 4,550,876 | 11/1985 | Kulesza et al. | 239/444 |
| 4,664,314 | 5/1987 | O'Brien et al. | 239/469 |

FOREIGN PATENT DOCUMENTS

| | | | |
|---|---|---|---|
| 850561 | 12/1939 | France | 239/468 |
| 1144009 | 10/1957 | France . | |
| 1262920 | 4/1961 | France . | |
| 14487 | 7/1895 | United Kingdom | 215/232 |

*Primary Examiner*—Andres Kashnikow
*Assistant Examiner*—Christopher G. Trainor
*Attorney, Agent, or Firm*—Neal J. Mosely

[57] ABSTRACT

A novel lawn sprinkler comprises a substantially flat base of molded plastic with a hollow plastic, inverted cup-shaped housing supported thereon. The cup-shaped housing has an inlet pipe molded integrally therewith with a fixed female threaded fitting for connection to a garden hose and opening tangentially into the interior thereof. The cup-shaped housing has cylindrical side walls and a flat top wall with curved peripheral internal top edge. The top wall has a central spray opening which is small at the inside and tapers outwardly at the top surface of the top wall. The cup-shaped housing fits into and is cemented in place in a groove molded in the upper surface of the flat base and has a projection which fits a recess in the base to orient the housing on said base.

1 Claim, 2 Drawing Sheets

LAWN SPRINKLER

BACKGROUND OF THE INVENTION

1. Field of the Invention

This invention relates generally to lawn sprinklers and more particularly to a sprinkler of molded plastic construction constructed of two molded pieces cemented together and having a tangential inlet opening and a top spray opening.

2. Brief Description of the Prior Art

Jenkins, U.S. Pat. No. 1,780,233 discloses a hollow lawn sprinkler with a square central opening for discharging a square patterned spray.

Butler, U.S. Pat. No. 2,519,738 discloses a sheet metal sprinkler which is dome shaped and has an inlet baffle directing water flow circumferentially and a central top opening for discharging a water spray.

O'Brien, U.S. Pat. No. 2,815,248 discloseds a spray nozzle with an internal configuration without moving parts and shaped to produce a whirling spray of water flowing therethrough.

O'Brien, U.S. Pat. No. 3,304,013 discloses a spray nozzle with an internal configuration without moving parts and shaped to produce a whirling spray of water flowing therethrough.

Wahlin, U.S. Pat. No. 3,326,473 discloses a spray nozzle with an internal configuration without moving parts and shaped to produce a whirling spray of water flowing therethrough.

Ikeuchi, U.S. Pat. No. 4,092,003 discloses a spray nozzle with an internal configuration without moving parts and shaped to produce a whirling spray of water flowing therethrough.

O'Brien, U.S. Pat. No. 4,664,314 discloses a spray nozzle with an internal configuration without moving parts and shaped to produce a whirling spray of water flowing therethrough.

Perche, French Patent No. 1,262,920 discloses a sheet metal sprinkler which is dome shaped and has a bottom inlet baffled to direct water flow circumferentially and a central top opening for discharging a water spray.

Troisgros, French Patent No. 1,144,009 discloses a hollow lawn sprinkler with a central opening for discharging a water spray and an inlet pipe extending circumferentially inside the sprinkler housing to direct water flow circumferentially and out through the central top opening.

Pettit, U.S. Pat. No. 3,550,859 discloses a hollow domed lawn sprinkler with a central opening for discharging a water spray and an inlet pipe extending tangentially inside the sprinkler housing with an open end portion shaped to direct water flow circumferentially and out through the central top opening.

The present invention is distinguished over the prior art in general, and these patents in particular by its substantially flat base of molded plastic with a hollow plastic, inverted cup-shaped housing supported thereon. The cup-shaped housing has an inlet pipe molded integrally therewith with a fixed female threaded fitting for connection to a garden hose and opening tangentially into the interior thereof. The cup-shaped housing has cylindrical side walls and a flat top wall with curved peripheral internal top edge. The top wall has a central spray opening which is small at the inside and tapers outwardly at the top surface of the top wall. The cup-shaped housing fits into and is cemented in place in a groove molded in the upper surface of the flat base and has a projection which fits a recess in the base to orient the housing on said base.

SUMMARY OF THE INVENTION

It is therefore a primary object of the present invention to provide a new and improved lawn sprinkler of two-piece molded plastic construction.

Another object of this invention to provide a new and improved lawn sprinkler of two-piece molded plastic construction which is simply constructed and easy to assemble and use.

Another object of this invention to provide a new and improved lawn sprinkler of two-piece molded plastic construction with a hollow curved dome having a central discharge opening and a tangential inlet.

A further object of this invention to provide a new and improved lawn sprinkler of two-piece molded plastic construction which produces a uniform spray over a wide range of water pressures and flow rates.

Other objects of the invention will become apparent from time to time throughout the specification and claims as hereinafter related.

The above noted objects and other objects of the invention are accomplished by a novel lawn sprinkler comprising a substantially flat base of molded plastic with a hollow plastic, inverted cup-shaped housing supported thereon. The cup-shaped housing has an inlet pipe molded integrally therewith with a fixed female threaded fitting for connection to a garden hose and opening tangentially into the interior thereof. The cup-shaped housing has cylindrical side walls and a flat top wall with curved peripheral internal top edge. The top wall has a central spray opening which is small at the inside and tapers outwardly at the top surface of the top wall. The cup-shaped housing fits into and is cemented in place in a groove molded in the upper surface of the flat base and has a projection which fits a recess in the base to orient the housing on said base.

DESCRIPTION OF THE PREFERRED EMBODIMENT

Figure 1:
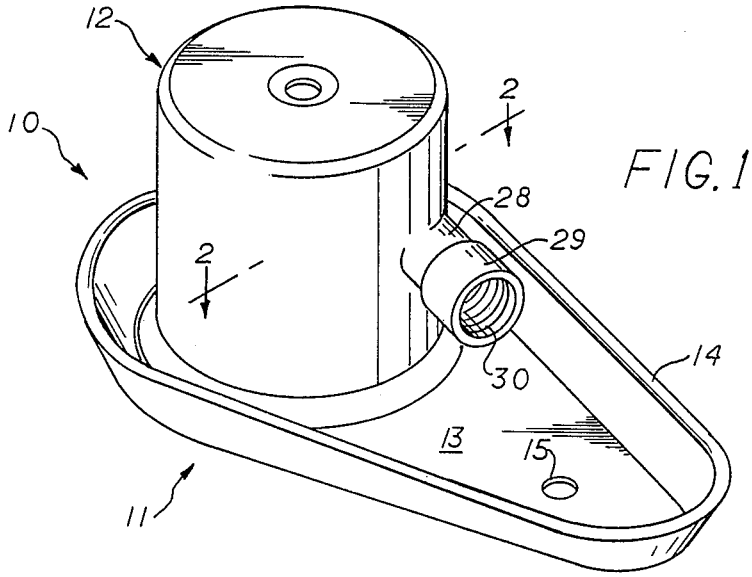
FIG. 1 is an isometric view of a lawn sprinkler illustrating a preferred embodiment of the present invention.
Figure 2:
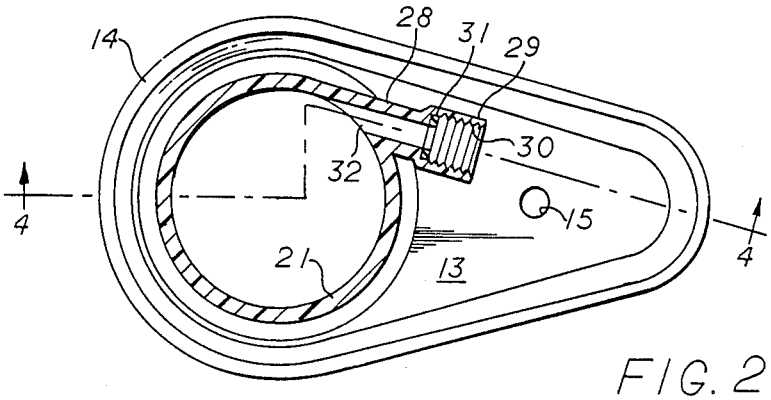
FIG. 2 is a sectional view taken on the line 2—2 of FIG. 1.
Figure 3:
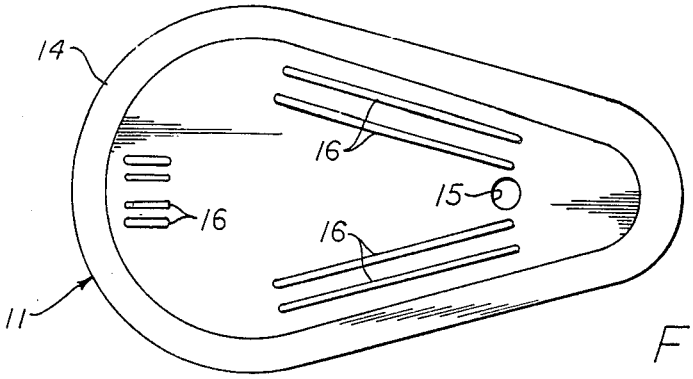
FIG. 3 is a bottom view modification of the lawn sprinkler apparatus of FIGS. 1 and 2.
Figure 4:
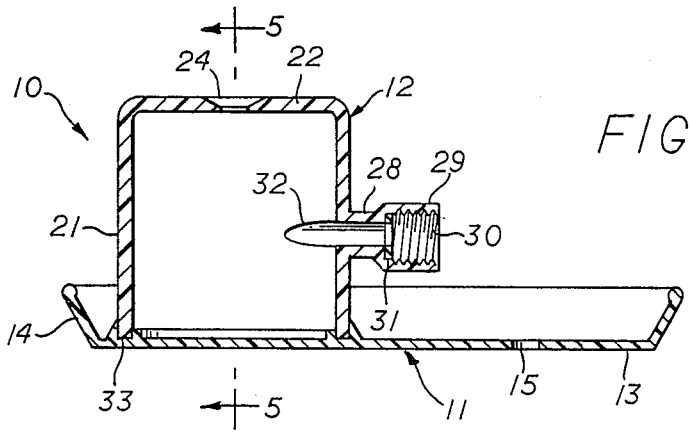
FIG. 4 is a sectional view taken on the line 4—4 of FIG. 2.
Figure 5:
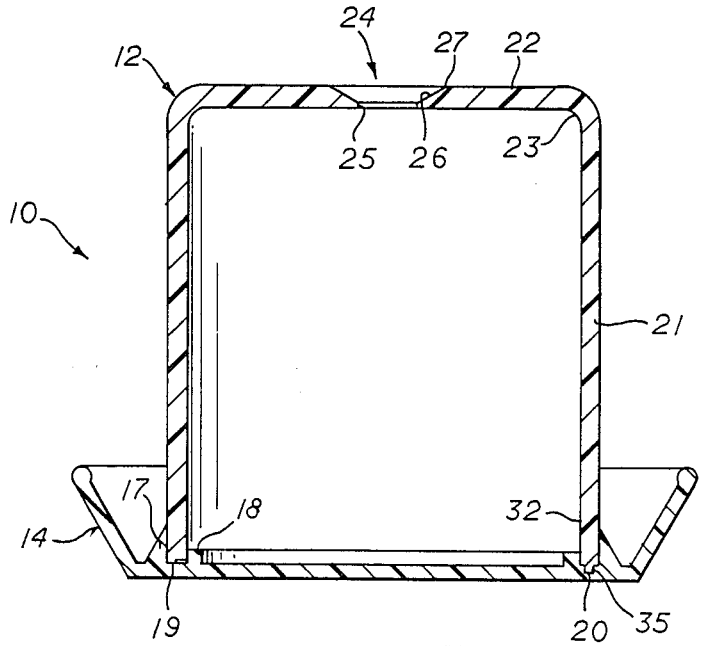
FIG. 5 is a sectional view taken on the line 5—5 of FIG. 4.
Figure 7:
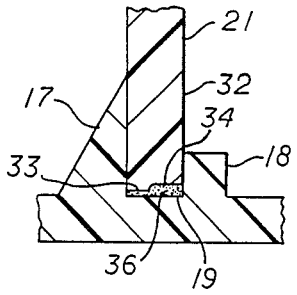
FIG. 7 is a detail sectional view of the connection between the other side of the cover portion and the base of the lawn sprinkler showing the locator pin which orients the cover portion on the base.
Figure 6:
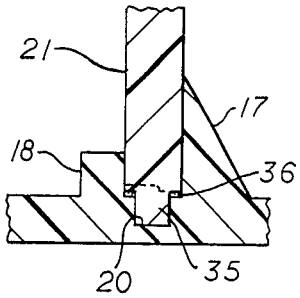
FIG. 6 is a detail sectional view of the connection between one side of the cover portion and the base of the lawn sprinkler.

Referring to the drawings by numerals of reference, there is shown in FIG. 1 a preferred embodiment of a lawn sprinkler 10 having a flat base member 11 and an inverted cup-shaped housing 12. Base member 11 and cup-shaped housing member 12 are each of a one-piece molded plastic construction. Any suitable structural plastic may be used. High-impact, UV-inhibited thermoplastics, such as polypropylene, high density polyethylene, polystyrene, and the like are preferred, although thermosetting resin may be used where economics permit.

Base member 11 is of one-piece molded plastic construction having a flat bottom 13 with a peripheral, dished rim 14 and a hole 15 for drainage and for hanging the sprinkler when not in use. The underside of base member 11 has a plurality of ribs 16 molded in the surface thereof which facilitate sliding the sprinkler along the ground during use. The upper surface of base member has a pair of circular bosses 17 and 18 at the larger end thereof with a circular groove 19 therebetween. The inner boss 18 is squared in cross section while the outer boss 17 is inclined or conical in cross section. Groove 19 has a single recess 20 which receives a projection on the cup-shaped housing member for orienting the same during assembly.

Inverted cup-shaped housing 12 has a cylindrical side wall 21 with a flat closed end or top wall 22 integral therewith. Walls 21 and 22 merge into each other at a curved internal top edge 23. Top wall 23 has a central, spray opening 24 which is smaller on the inside as at 25 and larger on the outside as at 27 with a conically tapered wall 26 therebetween.

An inlet pipe or conduit 28 is molded integrally with housing 12 and has an enlarged inlet portion 29 integral therewith and internally threaded (female threads) as at 30 for connection to a garden hose. A rubber or soft plastic washer 31 for sealing the hose connection. Conduit 28 opens into the interior of housing 12 in a discharge opening which is flush with the inner surface of wall 21 and substantially tangential thereto.

Inverted, cup-shaped housing 12 has an open, bottom end with an edge 33 having a groove 34 along the inner side. A projection or pin 35 is molded integrally with housing 12 and extends from edge 33. Pin 35 fits recess 20 in groove 19 in the upper surface of base member 11 for orienting housing 12 during assembly of the sprinkler. When cup-shaped housing is assembled, a layer of a plastic cement 36 is placed in the bottom of groove 19. Housing 12 has its edge 33 inserted into groove 19 and pressed into cement 36 with pin 35 inserted into recess 20. This orients housing 12 with inlet conduit 28 extending parallel to one edge of base member 11. When the cement 36 hardens or sets, the sprinkler is completely assembled. The complete unit therefore consists of only two molded pieces 11 and 12 cemented together. It is also feasable to fuse pieces 11 and 12 together by ultrasonic welding.

OPERATION

In operation, the sprinkler 10 is connected by enlarged threaded portion 29 or conduit 28 to a garden hose and water pressure applied. The flow of water enters tangentially through opening 32, spins around the chamber defined by housing 12 and exits in a spray through spray outlet opening 24.

The relationship of the inlet conduit 28 and outlet 25 spray opening 24 is substantially in accordance with my prior U.S. Pat. No. 3,550,859. The spray outlet opening 24 is positioned centrally of the top wall 22. The taper to the opening improves the spray which is discharged through the opening. Outlet opening 24 is sized so that flow restriction is not caused thereby. That is, the outlet opening 24 should be as large as the internal diameter of the inlet conduit 28 or sometimes even larger. If the outlet opening 24 is substantially smaller than the inlet conduit 28, then an overloading of the hollow housing 12 takes place which results in the water spurting vertically through hole 24 rather than exiting as a spray.

The diameter of the outlet spray opening 24 may be considerably larger than the inlet conduit 28 if the sprinkler is to be operated with high pressure water For ordinary home systems using city water pressure, e.g., 50 psi or less, the outlet 24 should be of the same size or only slightly larger than the inlet conduit 28. If water pressures of the order of 500–700 psi are used, outlet opening 24 would have to be several times larger than inlet conduit 24. It is also important that the top wall 22 of housing 12 be substantially flat with a curved peripheral edge along the cylindrical side wall of the housing. Concave or convex conical or curved flaring or the top wall results in an inferior spray.

The elimination of any projection of inlet conduit 28 into housing 12 makes the sprinkler easier and less expensive to manufacture and results in no loss of efficiency. The location of opening 32 precisely tangentially to the cylindrical wall 21 or housing 12 produces the desired spinning path of water entering the housing without the need for the conduit to project inside the housing.

The sprinkler 10 may be used as a free standing sprinkler and moved about the yard. Alternatively, it may be recessed into the ground with the top wall 22 and spray opening 24 flush with or possibly one or two inches below the surface of the ground for use in an underground watering system. This sprinkler is substantially free from plugging. Even when filled with small debris, the flow of water through the sprinkler will flush out the sprinkler housing 12.

While this invention has been described fully and completely with special emphasis upon several preferred embodiments, it should be understood that within the scope of the appended claims the invention may be practiced otherwise than as specifically described herein.

I claim:

1. A lawn sprinkler comprising a substantially flat base of molded plastic, a one-piece hollow plastic, inverted cup-shaped housing supported on said base, an inlet pipe molded integrally with said housing and having a fixed female threaded fitting for connection to a garden hose at the inlet end thereof, said inlet pipe opening tangentially into the interior of said housing with the opening flush with the inner surface thereof and molded as a single piece therewith with no portion thereof extending inside said housing, said cup-shaped housing having cylindrical side walls, an open bottom end, and a flat top wall with curved peripheral internal top edge, said top wall having an externally beveled central spray opening which is small at the inside and tapers outwardly at the top surface of said top wall, said flat base having a groove molded in the upper surface thereof, said cup-shaped housing having said open bottom end fitted into and cemented in place in said groove, the upper surface of said flat base having a locating recess therein, the edge of said housing having a projection which fits said recess in the base to orient the housing thereon, and the edge of said housing having a peripheral groove along substantially the entire length thereof which forms an annular cavity with the bottom wall of said groove which receives and confines the cement used to secure the housing to the sprinkler base.

* * * * *